US007874756B2

(12) United States Patent
Nuebel et al.

(10) Patent No.: US 7,874,756 B2
(45) Date of Patent: Jan. 25, 2011

(54) KIT FOR THE APPLICATION OF A FLUID PREPARATION

(75) Inventors: Thomas Nuebel, Hamburg (DE); Stefan Biel, Hamburg (DE)

(73) Assignee: Beiersdorf AG, Hamburg (DE)

( * ) Notice: Subject to any disclaimer, the term of this patent is extended or adjusted under 35 U.S.C. 154(b) by 1160 days.

(21) Appl. No.: 11/447,949

(22) Filed: Jun. 7, 2006

(65) Prior Publication Data

US 2007/0286669 A1 Dec. 13, 2007

(51) Int. Cl.
*B05C 11/00* (2006.01)

(52) U.S. Cl. ..... 401/266; 401/196; 401/261

(58) Field of Classification Search ..... 401/261, 401/265, 266, 267, 198, 199, 205, 88; 15/104.93, 15/104.94

See application file for complete search history.

(56) References Cited

U.S. PATENT DOCUMENTS

| | | | | |
|---|---|---|---|---|
| 3,007,192 | A * | 11/1961 | Quoss | 401/196 |
| 3,142,855 | A | 8/1964 | Gilchrist | |
| 4,683,001 | A * | 7/1987 | Floyd et al. | 106/3 |
| 4,738,887 | A * | 4/1988 | Govertsen | 428/133 |
| 4,889,441 | A * | 12/1989 | Tice | 401/131 |
| 4,921,694 | A | 5/1990 | Hoppe et al. | |
| 5,018,894 | A | 5/1991 | Goncalves | |
| 5,073,057 | A | 12/1991 | Lathrop et al. | |
| 5,318,778 | A | 6/1994 | Schmucker et al. | |
| 5,648,067 | A | 7/1997 | Dillenburg et al. | |
| 5,718,888 | A | 2/1998 | Klier et al. | |
| 5,904,151 | A * | 5/1999 | Gueret | 132/293 |
| 6,325,565 | B1 | 12/2001 | Girardot et al. | |
| 6,386,781 | B1 | 5/2002 | Gueret | |
| 6,528,154 | B1 | 3/2003 | Yamato | |
| 6,766,817 | B2 | 7/2004 | Da Silva | |
| 6,918,404 | B2 | 7/2005 | Dias da Silva | |
| 7,066,586 | B2 | 6/2006 | Da Silva | |
| 7,198,050 | B2 * | 4/2007 | Gopou et al. | 132/210 |
| 2001/0031168 | A1 | 10/2001 | Gueret | |
| 2002/0021932 | A1 | 2/2002 | Gueret | |
| 2002/0054783 | A1 | 5/2002 | Gueret | |
| 2002/0057939 | A1 | 5/2002 | Gueret | |
| 2003/0123919 | A1 | 7/2003 | Gueret | |
| 2003/0129016 | A1 | 7/2003 | Gueret | |
| 2006/0147251 | A1 | 7/2006 | Erickson et al. | |
| 2007/0277844 | A1 | 12/2007 | Gueret | |

FOREIGN PATENT DOCUMENTS

| | | |
|---|---|---|
| DE | 8324492 | 10/1983 |
| DE | 3409946 | 9/1985 |
| DE | 3708051 | 9/1987 |
| DE | 3740186 | 1/1989 |
| DE | 4016139 | 11/1990 |
| DE | 3938347 | 5/1991 |
| DE | 3938140 | 8/1991 |
| DE | 4009347 | 9/1991 |
| DE | 4204321 | 8/1993 |
| DE | 4229707 | 3/1994 |
| DE | 4229737 | 3/1994 |
| DE | 4237081 | 5/1994 |
| DE | 4309372 | 9/1994 |
| DE | 4324219 | 1/1995 |
| DE | 20305374 | 7/2003 |
| EP | 0155350 | 9/1985 |
| EP | 0232596 | 8/1987 |
| EP | 0312165 | 4/1989 |
| EP | 0872193 | 10/1998 |
| FR | 1461651 | 12/1966 |
| GB | 2187945 | 9/1987 |
| JP | 59-28909 | 2/1984 |
| JP | 59-222330 | 12/1984 |
| JP | 2-22724 | 2/1990 |
| JP | 4-44814 | 4/1992 |
| JP | 5-123216 | 5/1993 |
| JP | 8-228826 | 9/1996 |
| JP | 9-65921 | 3/1997 |
| JP | 10-85034 | 4/1998 |
| JP | 10-192048 | 7/1998 |
| JP | 2002-205760 | 7/2002 |
| WO | 98/12122 | 3/1998 |

(Continued)

OTHER PUBLICATIONS

English language abstract of JP 9-65921.

(Continued)

*Primary Examiner*—David J Walczak
(74) *Attorney, Agent, or Firm*—Greenblum & Bernstein, P.L.C.

(57) ABSTRACT

Kit for applying a fluid onto a surface and method using the kit. The kit includes a fluid having a yield point, a fluid container having at least one opening, and an applicator element having one or more porous areas for applying the fluid to a surface. The applicator element is located on the at least one opening of the container. The at least one porous area of the applicator element is in contact with the fluid. The fluid wets the at least one porous area of the applicator element but does not leak out of it as long as the porous area is not in contact with the surface. A porosity of the at least one porous area of the applicator element is related to the yield point of the fluid or vice versa.

44 Claims, No Drawings

FOREIGN PATENT DOCUMENTS

| | | |
|---|---|---|
| WO | 2005/039350 | 5/2005 |
| WO | 2006/069744 | 7/2006 |

OTHER PUBLICATIONS

English language abstract of JP10-192048.
English language abstract of JP 2-22724.
English language abstract of JP 5-123216.
English language abstract of JP 10-85034.
English language abstract of JP 59-28909.
English language abstract of JP 4-44814.
English language abstract of JP 59-222330.
English Language Abstract of DE 3409946.
English Language Abstract of DE 3938347.
English Language Abstract of DE 4204321.
English Language Abstract of DE 4229707.
English Language Abstract of DE 4229737.
English Language Abstract of JP 7-53344.
English Language Abstract of DE 4009347.
English Language Abstract of DE 8324492.

* cited by examiner

KIT FOR THE APPLICATION OF A FLUID PREPARATION

BACKGROUND OF THE INVENTION

1. Field of the Invention

The present invention relates to a kit which comprises a fluid with a yield point, a (dispensing) container with at least one opening for holding the fluid, and at least one at least partially porous applicator for being attached over the least one opening of the container and for applying the fluid from the container onto a surface. The fluid dampens the porous applicator, but does not leak out of the container through the applicator as long as no contact is established between the applicator and the surface.

2. Discussion of Background Information

From the prior art dispensers are known for the contact application of cosmetic liquids, such as, e.g., deodorizing liquids, perfumes, freshening media and the like onto human skin.

Thus DE 3409946 describes an applicator head in connection with a fluid supply container and an applicator ball pivoted in the head area of the same, a so-called roll-on dispenser.

DE 3938347 describes a fluid applicator with a liquid-permeable cap in connection with a fluid storage body, whereby a fluid quantity can be provided from the fluid storage body on an outer application area of the cap under pressure loading of at least one part of the fluid dispenser.

To use the dispenser, it is sufficient to turn over or shake the same once, so that the cap points downwards and the liquid located in the container impregnates the fluid storage body, the porosity of which should be adjusted to the viscosity of the fluid. In this manner, regardless of the frequency of use of the dispenser, a certain liquid supply is always kept available for dispensing inside the application head and even a slight pressure increase of the internal pressure inside the interior of the fluid supply container leads to a compression pressure on the liquid stored in the cells of the fluid storage body, so that it flows out through the sintered plastic cap to the outside onto the outer application area and can be applied to the surface of the body. Furthermore, pump mechanisms and valves are disclosed, which are to ensure a functional fluid transport in the container. The container has to be designed to be compressible, in order to ensure a dispensing to the surface, as described. On the other hand, even a slight internal pressure leads to a discharge of the liquid, which prevents storage of the container in an "upside down position" and leads to a soiling of the protective cap. The coordination of the porosity of the fluid storage body with the viscosity of the fluid thereby serves only to achieve an impregnation of the fluid storage body at all.

An applicator for a face or body lotion is described in FR-A-1461651. In this device the cover hood comprises a pad of foam material or the like. However, this is relatively thin and thus easily torn.

DE 4016139 describes a liquid applicator with a hood of inflexible, porous material whereby the neck of the bottle comprises a flexible, deformable section. Although a hood of porous, inflexible plastic or ceramic material does not run the risk of being torn like a foam pad, it has other disadvantages, such as in particular a reduced softness of the applicator and a lack of elasticity.

DE 3708051 describes a device for applying a substance with a liquid to pasty consistency, whereby before the first use the substance is insulated from the atmosphere in a container by a thin foil, which has to be perforated before the first application.

Moreover, dispensers are already known for the above-mentioned purposes, in which the outlet opening of the fluid supply container is covered by a fluid-permeable closure. However, when the liquid in the supply container impregnates the closure body under the influence of gravitational force, the deodorizing and/or perfuming liquid hereby flows unobstructed to the outer application area, so that a sufficient dosage cannot be made either. A control of the liquid discharge through a fibrous medium has also proven to be inadequate in practical use.

The disadvantage of all known application systems in combination with the liquids, pastes, lotions or creams to be applied, is that a complicated device and/or handling is required in order to ensure that the liquid is discharged only during use and to prevent discharge when not in use.

Furthermore, a major disadvantage of the known dispenser systems is that during the application, e.g., to the armpit, no adequate product replenishment is ensured, since there it must be held upside down, such as, e.g., with a roll-on deodorant. The consequence is that not enough product can be applied without going through laborious handling steps. With containers which have to be vertically rotated by 180° before application so that product reaches the application mechanism, no immediate application is possible, since the cosmetic product first has to reach the mechanism from which it only then can be applied. With high-viscosity media this can lead to undesirable waiting times unfavorable to use, which then mean that these products are not attractive to consumers.

However, the development of a simple "upside down" applicator system leads to other disadvantages. For example, the cosmetic preparation tends to leak out of the bottom of the applicator when not in use. The above known fluids were adjusted to be so highly viscous for precisely this reasons, i.e., so that an unintentional discharge of the fluid is avoided when not in use.

With sponge-like applicators, in addition there is the danger of microbic contamination if the applicator containers are stored upside down.

In view of the foregoing, it would be desirable to provide a combination for the application and optionally also the storage of fluids, in particular fluid cosmetic preparations, which is easy to use and does not require any complicated or additional means so as to be able to store the fluids and apply them easily and without problems.

It would therefore be advantageous to have available a container/applicator combination which comprises a fluid (preferably a cosmetic preparation) and which can be stored and used "upside down" without the fluid unintentionally leaking out and without a significant microbic contamination of the applicator portion occurring. It would also be desirable if the container could be used without problems in all angles of application.

SUMMARY OF THE INVENTION

The present invention provides a kit for applying a fluid (e.g., a liquid) to a surface. The kit comprises (i) a fluid having a yield point, (ii) a container having at least one opening (preferably located underneath the container) for holding the fluid and (iii) at least one applicator element (in the following simply referred to as "applicator") for applying the fluid from the container onto a surface (e.g., of an object or human skin). The applicator comprises one or more porous areas, whereby when the applicator is located on the at least one opening of the container and at least one porous area of the applicator is in contact with the fluid (e.g., by the container being turned upside down), the fluid dampens or wets (in the present specification and in the appended claims the terms "dampen", "impregnate" and "wet" are used interchangeably) this porous area but is not discharged therefrom as long as the porous area is not in contact with the surface onto which the fluid is to be applied.

In one aspect of the kit according to the invention, the ratio $\pi$=P/F, in which P is the porosity of the at least one porous area in % and F is the yield point of the fluid in Pa (Pascal), may have a value of from about 1.6 to about 999.9, e.g., a value of from about 10 to about 100, preferably a value of about 20 to about 35.

In another aspect, the fluid may have a yield point of at least about 0.1 Pa, e.g., a value of at least about 1 Pa or at least about 3 Pa and/or the fluid may have a yield point of not more than about 50 Pa, e.g., a value of not more than about 10 Pa or not more than about 5 Pa.

In another aspect of the kit according to the invention, the porosity of the at least one porous area of the applicator may be at least about 80%, e.g., at least about 90% or at least about 95%, and/or the porosity of the at least one porous area may be not higher than about 99.99%, e.g., no higher than about 99.9% or no higher than about 99.8%.

In another aspect of the kit according to the invention, the at least one porous area of the applicator may have an at least partially open-cell structure, and/or the at least one porous area of the applicator may have an at least partially closed-cell structure and there may be one or more channels completely penetrating this structure to hold and to transport the fluid through this at least partially closed-cell structure.

In another aspect of the kit according to the present invention, the applicator may have a single porous area. In a still further aspect, the volume of the at least one porous area may account for at least about 50%, e.g., at least about 99% of the total volume of the applicator.

In another aspect of the kit, the kit may comprise more than one applicator (e.g., two, three, four, five, six, seven, eight, nine or ten applicators).

In another aspect of the kit according to the invention, the container may have a single opening.

In another aspect of the kit, the (at least one) applicator may be disposed on the opening of the container.

In another aspect of the kit, the container may be a disposable container. Alternatively, the container may be designed to be refillable.

In another aspect of the kit according to the present invention, an applicator may be screwed, slid and/or pressed onto at least one opening of the container.

In another aspect of the kit, the fluid may be inside the container.

In another aspect of the kit, the kit may further comprise at least one additional (separate) container that contains the fluid.

In another aspect of the kit according to the present invention, the fluid may comprise a gel or a hydrogel.

In another aspect of the kit, the fluid may comprise a W/O emulsion.

In another aspect of the kit according to the present invention, the fluid may comprise a cosmetic composition. For example, the cosmetic composition may comprise at least one antiperspirant and/or deodorant agent and/or the cosmetic composition may comprise at least one antiperspirant-active aluminum compound, at least one $\alpha$-hydroxycarboxylic acid and water and/or the cosmetic composition may comprise mandelic acid.

In another aspect of the kit, the fluid may comprise at least one substance that counteracts a germ formation.

The present invention also provides a kit for the application of a fluid onto a surface, wherein the kit comprises (i) a fluid having a yield point, (ii) a container having at least one opening for holding the fluid and (iii) an applicator for applying the fluid from the container onto a surface. The applicator comprises one or more porous areas, wherein at least one porous area of the applicator has such a porosity that the ratio $\pi$=P/F, in which P is the porosity of the at least one porous area in % and F is the yield point in Pa, has a value of from about 1.6 to about 999.9.

The present invention further provides a method for applying a cosmetic composition onto human skin, wherein in this method a kit according to the present invention as set forth above (including the various aspects thereof) is used.

The present invention further provides a method for preventing a fluid with a yield point leaking out of a porous applicator dampened by the fluid for the application of the fluid to a surface, when the applicator is not in contact with the surface. The method comprises that, with an applicator with at least one porous area, the porosity of this area and/or the yield point of the fluid is selected such that the ratio $\pi$=P/F, in which P is the porosity in % and F is the yield point in Pa, has a value of from about 1.6 to about 999.9.

In one aspect of the method, the fluid may comprise a cosmetic composition.

In another aspect of the method, the surface may comprise human skin.

In another aspect of the method according to the present invention, the fluid may dampen the at least one porous area of the applicator substantially completely.

In another aspect of the method, the fluid may be contained in a container with an opening, which opening is substantially completely covered (and sealed) by the applicator.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description making apparent to those skilled in the art how the several forms of the present invention may be embodied in practice.

The kit according to the present invention comprises a (dispensing) container with at least (and preferably) one opening, at least one porous applicator that can be placed on this opening (e.g., by screwing, sliding or pressing) or is already disposed thereon and completely covers the opening, and at least one fluid that has a yield point. The container may already contain the fluid. However, it is also possible for the fluid to be in a container which is different from the dispensing container and, e.g., to be transferred into the dispensing container just before the actual use.

The applicator comprises at least one porous area (in the present specification and in the appended claims, "porous area" is used interchangeably with "porous part" and "porous section"). When the applicator comprises more than one porous part, there is at least one porous part with a porosity which is adjusted to the yield point of the fluid such that although the fluid can dampen this part, it does not leak out when this part is not in contact with a surface (e.g., a solid surface onto which the fluid is to be applied). Other porous areas which may possibly be present and do not meet this condition can, e.g., be such that although they permit a dampening by the fluid, they do not release the fluid or release it only under strong pressure, or such that they are not accessible to dampening by the fluid, or at least not to an appreciable extent. In many cases, the porous applicator will have only one porous area. Furthermore, the applicator can be essentially completely porous, or a part of the applicator can be produced from non-porous, solid material (which may, for example, surround the porous area, e.g., completely or partially and is preferably elastic).

The percentage of the outer surface area (i.e., of the surface area that can contact the surface to which the fluid is to be applied) of the at least one porous area of the applicator is preferably at least about 10% of the total outer surface area of the applicator, e.g., at least about 50%, at least about 75% or at least about 90% of the total outer surface area. Also, the percentage of the volume of the at least one porous area of the applicator is preferably at least about 10% of the total volume of the applicator, e.g., at least about 50%, at least about 75% or at least about 90% of the total volume.

The quotient of the porosity (in %) of the at least one porous area of the applicator and the (rheological) yield point (in Pa) of the fluid preferably has a value of from about 1.6 to about 999.9.

In a preferred embodiment the kit according to the present invention comprises a container with an opening a porous applicator that is disposed on the opening, and a cosmetic fluid inside the container. Due to its rheology, when the container is in an upside down position, the fluid dampens the applicator as a function of the porosity of the porous part of the applicator but does not leak out of the applicator as long as there is no contact between the applicator and a surface.

This makes it possible to use a cosmetic kit for storing a cosmetic preparation with the container opening pointing downwards, without the preparation leaking out of the container.

In an advantageous embodiment the container used according to the present invention has an opening that is secured against fluid leaking out with a porous applicator such as, e.g., a sponge-like material. Although the (preferably cosmetic) fluid is absorbed by the sponge-like material due to its rheological properties when the container is in an upside down position, it is not dispensed downwards through the applicator due to gravity. This is in particular the case when the above Nübiel number ($\pi$—number, i.e., the ratio of the porosity of the applicator to the yield point of the fluid) is in the range according to the present invention.

The fluid, preferably a cosmetic preparation, can be present in any desired form. Thus, for example, it can be or comprise an emulsion, a dispersion, a gel or a hydrogel. Preferably the fluid is an emulsion, in particular a W/O emulsion, even more preferably a white-colored emulsion. According to the present invention, the preparation has rheological properties, such as, e.g., a yield point.

A ready-for-use dispensing container of the kit according to the present invention comprises a storage container with at least one opening and a porous applicator that is disposed on the opening, as well as optionally a cover cap. The supply container preferably comprises a cylindrical vessel that is closed by a solid base on one side. It is to be noted however, that any type of container can be used for the purposes of the present invention as long as it is capable of holding a fluid and has an opening to which the applicator according to the present invention can be attached. An opening is located on the opposite side, which in a preferred embodiment is directly covered (and sealed) by a porous applicator. Due to the "upside down position," this part of the vessel may be referred to as the bottom, while the solid base faces upwards.

In the present specification, "upside down" means with the opening pointing downwards, and "vertical" with the opening pointing upwards.

The opening(s) of the container can be of any shape such as, e.g., circular, rectangular, annular, elliptical, elongated, irregular, etc. The shape of the applicator may correspond to that of the opening but this is not a requirement as long as the applicator is capable of substantially completely covering and sealing the opening.

A ready-for-use container preferably comprises only a single porous applicator that is positioned over the (single) opening. However, it is also possible for the container to have more than one opening, part or all of which respectively are covered or can be covered with a separate applicator. Otherwise, the kit according to the invention can comprise more than one porous applicator, even if the container has only one opening. This is useful, for example, when the applicator is not to be used over the entire service life of the container, but is to be replaced with a new applicator at regular intervals or as required (e.g., for hygienic reasons). It is also possible for the container to be a refillable container that is provided for dispensing more than one fluid and in which the porosity of the applicator has to be adapted to the rheological properties of the fluid respectively inside the container, in view whereof the use of different applicators with different porosities may be necessary or at least useful.

The applicator can be or become (sealingly) attached to the at least one opening of the container in any manner, e.g., by a twist connection or snap-on connection, by adhesion, sliding, etc. In particular when the container is a disposable container, the connection can also be permanent, i.e., the connection can be released only by destroying the applicator and/or the container. In many cases it can be advantageous in particular for hygienic reasons to attach the applicator to the container only shortly before use.

If the container is a (re)fillable container, the kit according to the present invention may comprise the fluid in a separate container. It is also possible for the dispensing container to already contain the fluid, and for the kit to comprise one or more refillable portions of the fluid in one or more separate containers (which usually are not dispensing containers).

Moreover, the container can comprise one or more elements that separate the applicator from the opening. Such elements may comprise, for example, a grid and/or a net (for example, made of plastic or metal), through which the fluid must first pass before it comes into contact with the applicator. Such an element may be useful in particular when the applicator is made of a very soft and/or yielding material that can profit from being supported by a grid, net or the like.

The applicator preferably comprises a porous, liquid-permeable sponge material that may be natural or synthetic. For example, the materials conventionally used in cosmetics, such as, e.g., polyethylene, polypropylene and polyurethane can be used as sponge materials. The porous area or areas of the applicator body can have coarse and/or fine structures. The porosity may be both a fine porosity as well as a coarse porosity, that can be designed in an open-cell or closed-cell manner. It is preferred for the applicator or applicators to be made of foam or to at least comprise foam portions. It is further preferred for the foam (or in general the porous area or areas of the applicator) to have at least in part (and preferably essentially completely) an open-cell structure.

With a closed porosity it is necessary for one or more passages to be present in the porous area or areas of the applicator, e.g., a sponge. In this respect, a system of several channels or openings is preferred as a passage, which snake through the applicator essentially vertically and through which the fluid (preferably a cosmetic product) can be transported.

In one embodiment the applicator body may comprise only a foam core or a foam core with one or more further outer areas of preferably open-cell foams or a nonwoven.

In other words, the applicator can comprise two or more areas of different composition and/or porosity. For example, the outermost layer of the applicator can be equipped with a very fine-cell soft foam. Additionally or alternatively, this outer layer can also have been processed with soft materials through flocking. The cell size (largest diameter) in this outer layer is preferably not more than about 100 μm for at least about 90% of the pores (and preferably for at least about 99% of the pores).

The at least one porous area of an applicator used according to the present invention can, of course, also comprise two or more different porous layers (preferably perpendicular to the flow direction of the fluid). For example, the porous area can have an inner layer (directed towards the container) and an outer layer (for contact with the surface to be treated). In this case it is necessary only for the outer layer to be adjusted regarding its porosity to the yield point of the fluid such that the outer layer is dampened by the fluid, but the fluid is prevented from leaking out of the outer layer as long as there is no contact between the outer layer and a surface of whatever type. The inner layer needs to be designed only such that it permits a passage of the fluid through the inner layer to the outer layer.

The porosity of a porous area of the applicator is defined in the present specification as the ratio of the volume of all the cavities of the porous area to the total volume of this porous area, in accordance with the customary definition of porosity. This is therefore an indicator of how much space the actual porous body fills by its cells, granularity or crevices within a certain volume or which cavities it leaves therein. As a rule, the cells are filled with air and/or fluid.

The porosity is usually given in percent or as a fraction (fractions of 1=%/100). Here the percentage value is taken as the starting point for calculating the Nübiel number (π—number).

The porous applicator can be produced according to methods known from the prior art. To produce a porous PU (polyurethane) foam applicator, for example, the main components of the synthetic polyurethane, i.e., polyalcohols and polyisocyanates, are intimately mixed. Through chemical reaction gas bubbles form that inflate the viscous mass and allow the foam to form. Wherever gas bubbles separated from one another by a synthetic skin strike against one another, bridges are formed. The thin skins between the individual foam cells are removed through thermal or chemical post-treatment and only the bridges remain. Those of skill in the art call this process reticulation. This is how the foam achieves its high open-cell porosity.

According to the invention, the porosity of the at least one porous area of the applicator is preferably at least about 80% and up to a maximum of about 99.99%. Even more preferred is a porosity of at least about 90%, in particular at least about 95%. Preferred upper limits of the porosity are about 99.8% or about 99.9%.

For the purposes of this invention, closed-cell foams that are provided with continuous channels are considered to be open-cell foams. These then also exhibit corresponding porosities. Suitable and preferred porous applicators are produced, for example, by Cosmogen of Paris, France. These applicators have a synthetic foam body with a cell size of less than <0.1 mm and have about 130 cells per centimeter. The outer surface of the applicator is preferably flocked such as, e.g., with very fine nylon threads that ensure a pleasantly soft skin contact.

With a ready-for-use dispensing container, the applicator can be protected, for example, by a protective cap, which can be removed before application and put back on after application. When attached, this cap is preferably positioned such that it touches the applicator only slightly or preferably not at all. This closure cap can be supported on the supply container. The dispensing container is preferably designed, and this is advantageously possible combining all the features of the combination according to the present invention, such that it can stand headfirst on the closure cap with the container pointing upwards. Thus when containing only small amounts of fluid, e.g., a cosmetic deodorant/antiperspirant preparation, it is ensured that the fluid dampens the applicator and can then be applied immediately.

Surprisingly and unexpectedly to those of skill in the art, the cosmetic formulation thus penetrates the sponge and is distributed in the applicator without leaking out of the applicator.

This is ensured according to the present invention by the fluid having a rheological yield point individually adapted to the application purpose and above all to the porosity of the applicator, or the porosity of the porous area of the applicator being adapted to the rheological properties of the fluid to be dispensed.

According to the present invention, the rheology of the fluid to be applied is preferably related to the porosity of the sponge applicator in order to allow the present invention to exhibit its full advantageous effect.

To remove the fluid from the container, an optionally present protective cap is first removed and then the applicator may be wiped over the area to be treated, in the event of a cosmetic preparation, for example, the surface of a hand, an arm, the face or the armpit. Only through the contact of the applicator surface with the surface to be treated, e.g., the skin, is the fluid, e.g., a cosmetic formulation, dispensed and an application occurs. Without this contact between the applicator and a surface, due to the coordinated adjustment of the yield point and the porosity of the applicator, the fluid does not leak out of the container or applicator.

Without wanting to be bound to any specific theory, it is speculated that by touching a surface, a very thin layer with thin capillaries is formed between the applicator and the surface to be dampened which is marked by the structure of the surface to be treated and the applicator surface. In the capillaries thus formed, capillary forces are formed which, as, e.g., also in a sponge, ensure the further transportation of the fluid. Without the contact described here, the capillary forces are lacking and no fluid transport occurs, so that no leaking occurs.

Dispensing the fluid is presumably caused by capillary forces that are present in the capillaries and pores of the porous applicator, e.g., of the sponge, and thus ensure an impregnation of the sponge with the fluid. However, these capillary forces end on the outer edge of the applicator. When the applicator is placed on the skin, presumably new very small distances occur between the applicator and the skin that in turn function as capillaries through which the fluid is transported further onto the skin.

In the case of conventional fluids without a yield point and randomly selected porosity of the applicator and in particular without the above π—number within the range according to the present invention, the product is distributed in the applicator and then flows out downwards due to the effect of gravity. One consequence thereof is that the protective cap fills up unacceptably with the product and an upside down storage of the container thus becomes impossible.

On the other hand, applicators with a porosity that is too low or a cell width that is too small are unable to hold, e.g., a cosmetic preparation and/or then to apply it to a surface (in particular the surface of the skin) optionally vertically or upside down or in other desired application angles. In addition, an application can then occur only with an increase in internal pressure, which in turn means a restriction in terms of the container material. Alternatively, in this case additional devices such as valves would have to be attached, which has a negative impact on the handling of the container and above all on the price.

According to the present invention, there is a connection between the porosity of the applicator and the yield point of the fluid which is preferably determined by the formula below.

The $\pi$ number (Nübiel number) defines as a function of the porosity of the applicator and the rheology of the fluid the necessary properties of the kit according to the invention. Negative influencing variables that cause the liquid not to flow out upon application or cause leaking during "upside down" storage, are thus eliminated. The dimensionless Nübiel number is defined as:

$\pi = P/F$ $\pi$ Nübiel number

P Porosity of the applicator in %

F Yield point of the fluid to be applied in Pa

According to the invention, the Nübiel number preferably has a value of from about 1.6 to about 999.9. Preferably the Nübiel number is at least about 10, e.g., at least about 20, and not higher than about 100, e.g., not higher than about 100.

For example, a gel with a yield point of 4 Pa and a foam applicator with a porosity of 97% are compatible according to the invention, since in this case the Nübiel number is about 24 (97/4) and thus the advantage occurs of non-leakage from the container when upside down.

Fluids that are preferred according to the present invention (in particular cosmetic preparations that can be advantageously present as gel or hydrogel) have a yield point of at least about 0.1 Pa, preferably at least about 1 Pa, in particular at least about 3 Pa. Yield points of not higher than about 50 Pa, preferably not higher than about 10 Pa, in particular not higher than about 5 Pa, are particularly preferred.

The yield point or the flow point is a term for the smallest shearing stress above which a plastic material behaves rheologically like a liquid (DIN 1342-1: 1983-10). The determination of the yield point occurs by recording a flow curve (according to DIN 53019: 1980-05; DIN 53214: 1982-02). The value obtained depends very much on the time scale (load rate), on which the measurement is based. This is independent of whether the measurement is made with a viscometer controlled by shearing stress or by speed. Short timescales (quick loads) as a rule yield higher values for the yield point. Too high a yield point can be the cause of flow defects. On the other hand, the tendency of the liquid formulation to flow away is suppressed with a suitably adjusted yield point.

The measurement of the yield point for the purposes of the present invention can be carried out, for example with an SR-2000 rheometer by Rheometric Scientific, as follows: the temperature is kept constant at 25° C. with a Peltier element, prior to the test a recovery time of 5 minutes is first allowed. With a coaxial plate/plate measuring system made of plastic with a diameter of 25 mm and a plate spacing of 1 mm, a shearing stress time ramp of 40 Pa/min over the range of from 0 Pa to 800 Pa is selected. To determine the yield point, the viscosity is plotted logarithmically over the linear shearing stress and the viscosity maximum, thus the critical shearing stress, is given with the relevant maximum viscosity. Formulations without yield point show no maximum.

On the other hand, the tendency of the liquid formulation to flow away can be suppressed with suitably adjusted yield point.

Due to their non-Newtonian property, formulations with yield points tend to leak out less and are thus suitable for easier dispensing and application.

The advantage of the preparation with a yield point used according to the present invention is that leaking out of the applicator is prevented due to the yield point, since in the absence of shearing the preparation does not flow.

With the development of a gel with higher yield point, according to the present invention the porosity of the applicator would have to be adjusted. Usually, however, a specific applicator with a predetermined porosity is present, so that the yield point of the preparation is normally adjusted to the porosity of the applicator. It is thus possible, inter alia, to produce cosmetic products with individual product characteristics, e.g., a skin care product with a low yield point that can nevertheless be easily applied upside down or vertically onto the skin from an applicator with low porosity.

With a given yield point of the fluid or porosity of the applicator, the respective other parameter can be adjusted according to the present invention via the Nübiel number. The crucial difference compared to the prior art is, inter alia, that according to the present invention a relationship is defined between the yield point of the fluid, i.e., not only the viscosity, and the porosity of the applicator.

The fluid used according to the present invention can have various applications. For example, it can be a cleaning and/or disinfecting composition that can be used in industry and/or in the home for cleaning and/or disinfecting any kind of surfaces (such as, e.g., of floors, tables, countertops, etc.). The purpose also determines the size (i.e., the surface provided for the contact with the surface to be treated with the fluid) of the applicator, which can be, e.g., in the range of from about 0.1 to about 1000 $cm^2$.

By way of non-limiting example, in the case of a fluid for cleaning floors and the like, the dispensing container of the kit of the present invention may take the form of (or include) an at least partially hollow broom stick for holding the cleaning liquid) and the "broom" may comprise the applicator.

The fluid of the kit of the present invention preferably is a W/O emulsion. Also, the fluid preferably is a cosmetic preparation and in particular an antiperspirant and/or deodorant preparation. Moreover, the kit is preferably for use in skin care, in which an individual position, application direction and application angle of the applicator is desired and possible according to the present invention.

An easy application of cosmetic preparations at all application angles is possible for the first time without restrictions with preferred embodiments of the kit according to the invention.

In this respect, application angles can be, e.g., upside down, i.e., with the opening downwards perpendicular, with the opening upwards horizontal, with the opening pointing sideways or all the variations in between, whereby the type and amount of application can be selected as desired.

For example, in the application of a shaving gel or skin care lotion, the corresponding preparation can be applied preferably on any part of the face without difficulty and without help or without wetting the hands. Even parts difficult to access can thereby be reached and fluid applied there, although the container has the opening pointing upwards.

Storing upside down and applying cosmetic preparations in all directions is preferably possible synchronously or successively with the kit according to the invention.

It is preferable for the fluid to comprise one or more antiperspirant and/or deodorant agents.

As antiperspirant agent, advantageously activated acid aluminum and/or aluminum/zirconium salts can be incorporated in aqueous solution. In this case, the described concentration ranges relate to the so-called active contents of the antiperspirant complexes: with the aluminum compounds to nonaqueous complexes, with the aluminum/zirconium compounds to nonaqueous and buffer-free complexes. Glycin is customarily used as a buffer here.

The following list of antiperspirant agents for advantageous use is by no means intended to be limiting:

Aluminum salts (of the empirical formula $[Al_2(OH)_mCl_n]$, wherein m+n=6):

- Activated aluminumchlorohydrate $[Al_2(OH)_5Cl]\times H_2O$
- Activated Al complexes: Reach 501 (Reheis), Aloxicoll 51L
- Activated aluminumsesquichlorohydrate $[Al_2(OH)_{4.5}Cl_{1.5}]\times H_2O$
- Activated Al complexes: Reach 301 (Reheis)

Aluminum-zirconium salts:

- Aluminum/zirconium trichlorhydrex glycin $[Al_4Zr(OH)_{13}Cl_3]\times H_2O\times Gly$
- Standard Al/Zr complexes: Rezal 33GC (Reheis), AZG-7164 (Summit)
- Aluminum/zirconium tetrachlorhydrex glycin $[Al_4Zr(OH)_{12}Cl_4]\times H_2O\times Gly$
- Standard Al/Zr complexes: Rezal 36, Rezal 36G, Rezal 36 GC (Reheis), AZG-368 (Summit),
- Aluminum/zirconium pentachlorhydrex glycin $[Al_8Zr(OH)_{23}Cl_5]\times H_2O\times Gly$
- Standard Al/Zr complexes: Rezal 67 (Reheis), Zirkonal L540, Zirkonal L530 PG (Giulini)
- Aluminum/zirconium octachlorhydrex glycin $[Al_8Zr(OH)_{20}Cl_8]\times H_2O\times Gly$:
- Reach AZP—908 SUF activated aluminum zirconium tetrachlorhydrex GI
- Reach AZZ—902 SUF activated aluminum zirconium trichlorhydrex Glyc Likewise advantageously, however, glycin-free aluminum/zirconium salts can also be used.

The antiperspirant agents are used in formulations according to the invention preferably in an amount of from about 1% to about 35% by weight, particularly preferably from about 1% to about 20% by weight, based on the total mass of the formulations.

As is known, the activated aluminum complex salts (AACH) decompose in water back into their original equilibrium state so that in aqueous preparations an increased effectiveness is lost.

A use of the activated ACH types (AACH) has therefore hitherto been useful only in nonaqueous systems, as otherwise a reconversion to the molecular size distribution, as occurs in classic ACH solutions, is possible. Nonaqueous systems in the form of suspensions make it possible in this case to also use AACH types.

A microbic contamination of the applicator impregnated with the fluid can preferably be prevented according to the present invention by the addition of additives which prevent a microbic contamination or counteract a microbic contamination, such as, e.g., aluminum chlorohydrate (ACG), to the fluid.

The advantage of the addition of an aluminum-based antiperspirant agent is that, in addition to the advantages described, a microbic contamination can thus be avoided or reduced at the same time. For example, aluminum chlorohydrate has antibacterial properties and therefore also acts as a preservative and can counteract a microbic contamination.

Moreover, a preparation is preferred which comprises the combination of α-hydroxycarboxylic acid, in particular mandelic acid, and an aluminum-based antiperspirant agent, in particular activated ACH (AACH), since in this case no destruction of the activation of the AACH is observed.

By means of the α-hydroxycarboxylic acids, in particular mandelic acid, surprisingly an AT preparation can be produced, which renders possible the required properties, such as retention of the activated condition of the AACH, increased effectiveness and advantageously a low stickiness and moreover also the adjustment of a desired yield point of the preparation. Furthermore, the formulation according to the present invention is very quickly absorbed by the skin without any residues.

A combination preferably used according to the present invention therefore comprises one or more AT agents, one or more α-hydroxycarboxylic acids, in particular mandelic acid, and water and via a unique thickening mechanism renders possible the production of a preferably transparent cosmetic preparation. The user thus has available a water-white and yet thoroughly effective preparation. The preparation in gel form can easily be applied from the container, and it has a pleasant feeling on the skin due to low or no stickiness.

Advantageously, antiperspirants can be added to the preparations used according to the present invention. The usual cosmetic deodorants are based on different principles.

Through the use of antimicrobial substances in cosmetic deodorants, the bacterial flora on the skin can be reduced. Ideally only the odor-causing microorganisms should thereby be effectively reduced. The flow of sweat itself is not to be affected thereby. Ideally only the microbial decomposition of the sweat is stopped temporarily. Also the combination of astringents with antimicrobially effective substances in one and the same preparation is customary.

All the agents customary for deodorants can be used advantageously, for example, odor-maskers such as the customary fragrance constituents, odor absorbers, for example, the sheet silicates described in DE 40 09 347, of these in particular montmorillonite, kaolinite, illite, beidellite, nontronite, saponite, hectorite, bentonite, smectite, furthermore, for example, zinc salts of ricinoleic acid. Germicidal agents are also suitable for incorporation into the preparations used according to the present invention. Advantageous substances are, for example, 2,4,4'-trichloro-2'-hydroxydiphenyl ether (Irgasan), 1,6-di-(4-chlorophenyl-biguanido)-hexane (chlorhexidine), 3,4,4'-trichlorocarbanilide, quaternary ammonium compounds, clove oil, mint oil, thyme oil, triethyl citrate, farnesol (3,7,11-trimethyl-2,6,10-dodecatrien-1-ol) and the active agents described in DE 37 40 186, DE 39 38 140, DE 42 04 321, DE 42 29 707, DE 42 29 737, DE 42 37 081, DE 43 09 372, and DE 43 24 219. Also sodium bicarbonate can be used advantageously.

The amount of the deodorants (one or more compounds) in the preparations is usually from about 0.01% to about 10% by weight, preferably from about 0.05% to about 5% by weight, based on the total weight of the preparation.

Of course, the cosmetic (and dermatological) formulations according to the invention can comprise cosmetic auxiliaries such as are conventionally used in such formulations, for example preservatives, bactericides, perfumes, substances for preventing foaming, dyestuffs, pigments which have a coloring action, thickeners, humidifying and/or humectant substances, or other customary constituents of a cosmetic or dermatological formulation, such as alcohols, polyols, polymers, foam stabilizers, or silicone derivatives.

EXAMPLES OF PREPARATIONS (FLUIDS) FOR USE IN THE KIT ACCORDING TO THE PRESENT INVENTION

| | Example | | | |
|---|---|---|---|---|
| INCI name(s) | 1 % by weight | 2 % by weight | 3 % by weight | 4 % by weight |
| Aluminum chlorohydrate | | 10.0 | 20.0 | |
| Butylene glycol | 3.0 | | | 3.0 |
| C12-15 Alkyl benzoate | | 0.2 | 2.0 | |
| Cellulose gum | 0.2 | | | 1.0 |
| Cetyl alcohol | | 1.5 | 2.3 | |
| Dicaprylyl ether | 3.0 | | | 2.8 |
| Fragrance | 1.2 | 1.1 | 0.8 | 1.3 |
| Glyceryl isostearate | 3.0 | | | 3.2 |
| Glyceryl stearate | | | 4.0 | |
| Isoceteth-20 | 4.3 | | | 4.5 |
| Isohexadecene | | | 5.2 | |
| Mineral oil | 2.3 | | 5.0 | 1.7 |
| PEG-150 Distearate | 1.0 | | | 1.0 |
| PEG-40 Stearate | | | 3.5 | |
| PPG-15 Stearyl Ether | 2.0 | 4.8 | | 2.0 |
| Steareth-2 | | 2.2 | | |
| Steareth-21 | | 1.9 | | |
| Talc | | 0.4 | | |
| Water | 80.0 | 77.9 | 57.2 | 79.0 |
| Total: | 100.0 | 100.0 | 100.0 | 100.0 |

The fluids of examples 1-4 have a yield point in the range of from about 1 to about 7 Pa.

| | Examples | | |
|---|---|---|---|
| | 5 | 6 | 7 |
| Activated aluminum chlorohydrate | 5 | 10 | 10 |
| Mandelic acid | 1.4 | 1.8 | 2 |
| Sodium citrate | — | — | 1 |
| Water | 93.6 | 88.2 | 87 |
| Total | 100 | 100 | 100 |

The fluids of examples 5-7 with mandelic acid have a yield point in the range of from about 3 to about 6 Pa.

The entire disclosures of all of the above listed documents are expressly incorporated by reference herein.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A kit for applying a fluid onto a surface, wherein the kit comprises (i) a fluid having a yield point, (ii) a container having at least one opening, for holding the fluid, and (iii) an applicator element that comprises one or more porous areas for applying the fluid to a surface, and is capable of being attached to the at least one opening of the container, wherein when the applicator element is located on the at least one opening of the container and at least one porous area of the applicator element is in contact with the fluid, the fluid wets the at least one porous area of the applicator element but does not leak out of it as long as the porous area is not in contact with the surface, wherein a porosity of the at least one porous area of the applicator element is related to the yield point of the fluid or vice versa, and wherein the at least one porous area of the applicator element one of:

absorbs the fluid so that the fluid does not leak out of it as long as the at least one porous area is not in contact with the surface; and holds, transports and prevents the fluid from leaking out of it as long as the at least one porous area is not in contact with the surface.

2. The kit of claim 1, wherein a ratio $P/F=\pi$ has a value of from about 1.6 to about 999.9, P being the porosity of the at least one porous area in % and F being the yield point of the fluid in Pa.

3. The kit of claim 2, wherein $\pi$ has a value of from about 20 to about 35, F has a value of from about 3 to about 5, a volume of the at least one porous area of the applicator element accounts for at least about 99% of a total volume of the applicator element, and the fluid is held inside the container and comprises a cosmetic composition.

4. The kit of claim 2, wherein $\pi$ has a value of from about 10 to about 100.

5. The kit of claim 4, wherein $\pi$ has a value of from about 20 to about 35.

6. The kit of claim 1, wherein the yield point of the fluid is about 3 Pa.

7. The kit of claim 6, wherein the yield point of the fluid is not higher than about 50 Pa.

8. The kit of claim 1, wherein the yield point of the fluid is at least about 3 Pa.

9. The kit of claim 8, wherein the yield point of the fluid is not higher than about 5 Pa.

10. The kit of claim 1, wherein the porosity of the at least one porous area is at least about 80%.

11. The kit of claim 10, wherein the porosity is at least about 95%.

12. The kit of claim 1, wherein the porosity of the at least one porous area is not higher than about 99.99%.

13. The kit of claim 12, wherein the porosity is not higher than about 99.8%.

14. The kit of claim 1, wherein the at least one porous area of the applicator element has an at least partially open-cell structure.

15. The kit of claim 1, wherein the at least one porous area of the applicator element has an at least partially closed-cell structure and one or more channels completely penetrating this structure to hold and transport the fluid through this closed-cell structure are present therein.

16. The kit of claim 1, wherein the applicator element has a single porous area.

17. The kit of claim 1, wherein a volume of the at least one porous area accounts for at least about 50% of a total volume of the applicator element.

18. The kit of claim 17, wherein the volume of the at least one porous area accounts for at least about 99% of the total volume of the applicator element.

19. The kit of claim 1, wherein the kit comprises more than one applicator element.

20. The kit of claim 1, wherein the container has a single opening.

21. The kit of claim 20, wherein the applicator element is sealingly attached to the opening of the container.

22. The kit of claim 1, wherein the applicator element is capable of being twisted onto the at least one opening of the container.

23. The kit of claim 1, wherein the applicator element is capable of being snapped onto the at least one opening of the container.

24. The kit of claim 1, wherein the applicator element is capable of being slid onto the at least one opening of the container.

25. The kit of claim 1, wherein the applicator element is permanently attached to the at least one opening of the container.

26. The kit of claim 1, wherein the container contains the fluid.

27. The kit of claim 1, wherein the kit further comprises at least one additional container that contains the fluid.

28. The kit of claim 1, wherein the container comprises a cylindrical vessel.

29. The kit of claim 1, wherein the fluid comprises a gel or a hydrogel.

30. The kit of claim 1, wherein the fluid comprises a W/O emulsion.

31. The kit of claim 1, wherein the fluid comprises a cosmetic composition.

32. The kit of claim 31, wherein the cosmetic composition comprises at least one of an antiperspirant and a deodorant agent.

33. The kit of claim 32, wherein the cosmetic composition comprises at least one antiperspirant-active aluminum compound, mandelic acid and water.

34. The kit of claim 1, wherein the fluid comprises at least one substance which counteracts a germ formation.

35. A kit for applying a fluid to a skin surface, wherein the kit comprises as distinct and separate elements thereof (i) a fluid having a yield point, (ii) a container having at least one opening for holding the fluid, and (iii) an applicator element that comprises one or more porous areas for applying the fluid to a skin surface, and is capable of being attached to the at least one opening of the container, wherein at least one porous area of the applicator element has such a porosity that a ratio $\pi$=P/F has a value of from about 1.6 to about 999.9, P being a porosity of the at least one porous area in % and F being the yield point of the fluid in Pa, wherein the porosity of the at least one porous area of the applicator element is adjusted to the yield point of the fluid or vice versa, and wherein the at least one porous area of the applicator element one of:

absorbs the fluid so that the fluid does not leak out of it as long as the at least one porous area is not in contact with the skin surface; and holds, transports and prevents the fluid from leaking out of it as long as the at least one porous area is not in contact with the skin surface.

36. The kit of claim 35, wherein $\pi$ has a value of from about 20 to about 35.

37. The kit of claim 36, wherein F is from about 3 Pa to about 5 Pa.

38. The kit of claim 36, wherein P is from about 95% to about 99.8%.

39. The kit of claim 35, wherein the container contains the fluid and the fluid is a cosmetic composition.

40. The kit of claim 35, wherein the container has a single opening.

41. The kit of claim 40, wherein the applicator element is capable of being slid, snapped or twisted onto the opening of the container.

42. A method for applying a cosmetic composition to human skin, wherein the method comprises applying the cosmetic composition with an applicator element that is disposed on an opening of a container which contains the cosmetic composition, the cosmetic composition, the applicator element and the container being comprised in the kit of claim 1 and the yield point being about 3 Pa.

43. A method for preventing a fluid having a yield point from leaking out of a porous applicator element for applying the fluid to a surface which is wetted by the fluid when the applicator element is not in contact with the surface, wherein the method comprises selecting an applicator element with at least one porous area such that a ratio $\pi$=P/F has a value of from about 1.6 to about 999.9, P being a porosity of the at least one porous area in % and F being the yield point of the fluid in Pa, adjusting the porosity of the at least one porous area of the applicator element to the yield point of the fluid or vice versa and one of:

absorbing, via the at least one porous area, the fluid so that the fluid does not leak out of it as long as the at least one porous area is not in contact with the surface; and holding, transporting and preventing, via the at least one porous area, the fluid from leaking out of it as long as the at least one porous area is not in contact with the surface.

44. The method of claim 43, wherein the surface comprises human skin.

* * * * *